US005681203A

United States Patent [19]

Arnold

[11] Patent Number: 5,681,203

[45] Date of Patent: Oct. 28, 1997

[54] BUBBLE POPPING DEVICE

[76] Inventor: Melvin Arnold, P.O. Box 696, Wheatley Heights, N.Y. 11798-0696

[21] Appl. No.: 578,420

[22] Filed: Dec. 26, 1995

[51] Int. Cl.[6] ..... A63H 33/00

[52] U.S. Cl. ..... 446/181; 446/397; 446/491; 428/178; 428/906; 242/598

[58] Field of Search ..... 446/181, 213, 446/397, 491; 428/43, 178, 14, 906; 242/598, 598.5

[56] References Cited

U.S. PATENT DOCUMENTS

| | | | |
|---|---|---|---|
| 2,244,804 | 6/1941 | Robinson | 242/598.5 |
| 3,042,278 | 7/1962 | McCullough | 428/906 |
| 4,100,681 | 7/1978 | Hollander | 428/178 |
| 4,378,391 | 3/1983 | Alen | 446/181 |
| 4,417,936 | 11/1983 | Gaffney | 428/178 |
| 4,576,669 | 3/1986 | Caputo | 428/178 |
| 4,773,532 | 9/1988 | Stephenson | 428/906 |
| 4,911,671 | 3/1990 | Rogers | 446/397 |
| 5,041,317 | 8/1991 | Greyvenstein | 428/43 |
| 5,186,988 | 2/1993 | Dixon | 428/43 |
| 5,484,318 | 1/1996 | Mayert et al. | 446/397 |

FOREIGN PATENT DOCUMENTS

| | | | |
|---|---|---|---|
| 2225536 | 6/1990 | United Kingdom | 446/491 |

*Primary Examiner*—Robert A. Hafer
*Assistant Examiner*—Jeffrey D. Carlson
*Attorney, Agent, or Firm*—Michael I. Kroll

[57] ABSTRACT

A bubble popping device (10) includes a piece of bubble wrap (12) and a frame (14) about the perimeter of the piece of bubble wrap (12). A person can grasp the frame (14) and squeeze bubble portions of the piece of bubble wrap (12) to make popping noises when the bubble portions brake. An alternate bubble popping device (36) is also provided and consists of a roll of bubble wrap (38) with a dispenser (40) for holding the roll of bubble wrap (38) thereon. A hanger (42) extends from the dispenser (40) for retaining the dispenser (40) onto a top back portion (44) of a backrest (46) of a first stadium seat (48). A person (50) sitting on a second stadium seat (52) directly behind the first stadium seat (48) can pull the roll of bubble wrap (38) on the dispenser (40) and squeeze bubble portion of the roll of bubble wrap (38) to make popping noises when the bubble portions brake.

3 Claims, 3 Drawing Sheets

BUBBLE POPPING DEVICE

BACKGROUND OF THE INVENTION

1. Field of the Invention

The instant invention relates generally to noisemakers and more specifically it relates to a bubble popping device.

2. Description of the Prior Art

Numerous noisemakers have been provided in prior art that are adapted to produce sounds, such as horns, rattles and clappers, which are especially used to make these sounds at parties, celebrations and events. While these units may be suitable for the particular purpose to which they address, they would not be as suitable for the purposes of the present invention as heretofore described.

SUMMARY OF THE INVENTION

A primary object of the present invention is to provide a bubble popping device that will overcome the shortcomings of the prior art devices.

Another object is to provide a bubble popping device that is a piece of bubble wrap with indicia thereon and mounted in a frame, whereby a person can use the device to pop the bubbles and make noise at sports arenas or other exhibition areas.

An additional object is to provide a bubble popping device in which a roll of perforated pieces of the bubble wrap can be distributed from a dispenser that is hung on the back of a stadium seat.

A further object is to provide a bubble popping device that is simple and easy to use.

A still further object is to provide a bubble popping device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
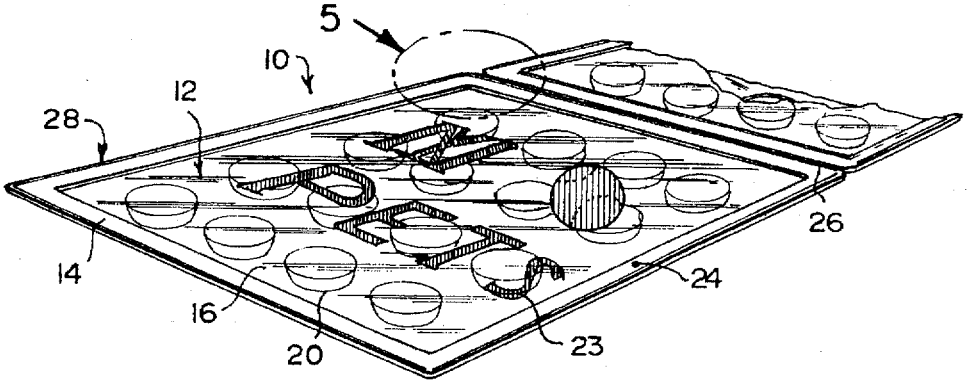
FIG. 1 is a perspective view of a first embodiment of the instant invention, showing a piece of bubble wrap in a frame with indicia printed thereon.
Figure 2:
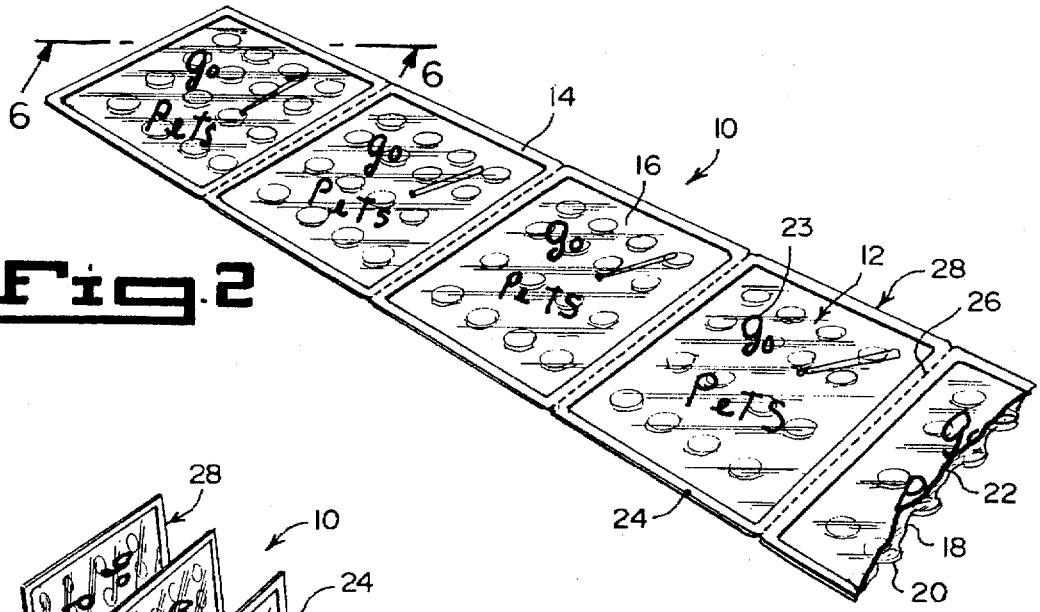
FIG. 2 is a perspective view of the first embodiment, in which a plurality of frames are perforated together in a strip.
Figure 3:
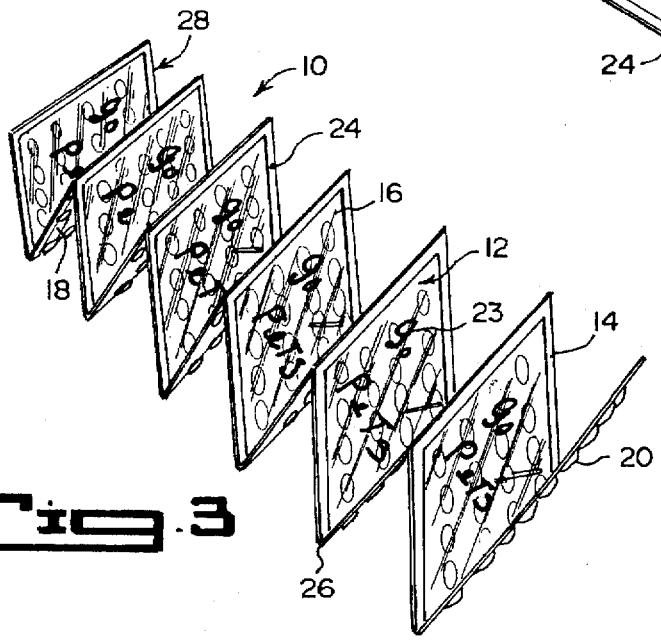
FIG. 3 is a perspective view similar to FIG. 2, with the strip partly folded up.

Turning now descriptively to the drawings, in which similar reference characters denote similar elements throughout the several views, FIGS. 1 through 6 illustrate a bubble popping device 10 comprising a piece of bubble wrap 12 and a frame 14 about the perimeter of the piece of bubble wrap 12. A person can grasp the frame 14 and squeeze bubble portions of the piece of bubble wrap 12 to make popping noises when the bubble portions break.

The piece of bubble wrap 12 includes a first thin flexible plastic sheet 16 being completely flat. A second thin flexible plastic sheet 18 has a plurality of circular shaped cups 20 formed therealong. A heat seal 22 is for attaching the first thin flexible plastic sheet 16 to the second thin flexible plastic sheet 18, so as to enclose all of the circular shaped cups 20 with a small amount of air to form the bubble portions.

The person can squeeze the circular shaped cups 20 between a thumb and finger to break them and make the popping noises. Indicia 23 can be printed upon the first thin flexible plastic sheet 16, which can be a team logo, an emblem, words, pictures and other identification information thereof.

The frame 14 is made out of a durable lightweight material 24. The durable lightweight material 24 can be cardboard. The durable lightweight material 24 can also be plastic.

A series of the frames 14 with the pieces of bubble wrap 12 can be attached together by perforations 26, to form an elongated strip 28. Each frame 14 with the piece of bubble wrap 12 can be removed from the strip 28, by tearing along the perforations 26.

Figure 4:
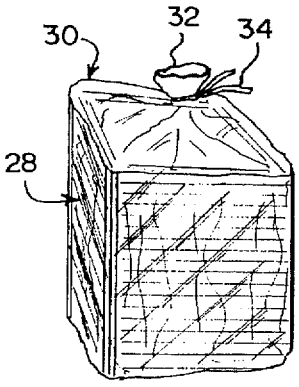
FIG. 4 is a perspective view showing a package used for storing the folded up strips therein.
Figure 5:
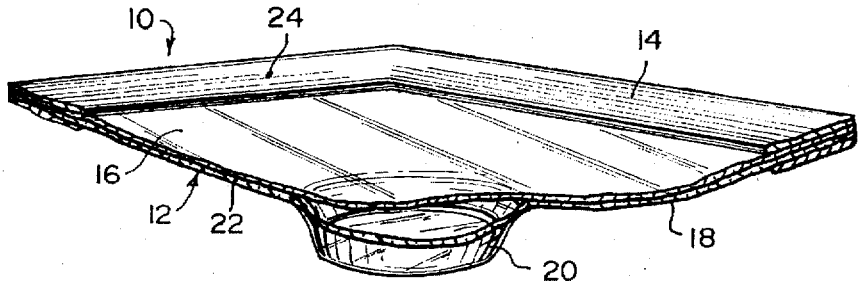
FIG. 5 is an enlarged perspective view with parts in section of the area as indicated by arrow 5 in FIG. 1.
Figure 6:
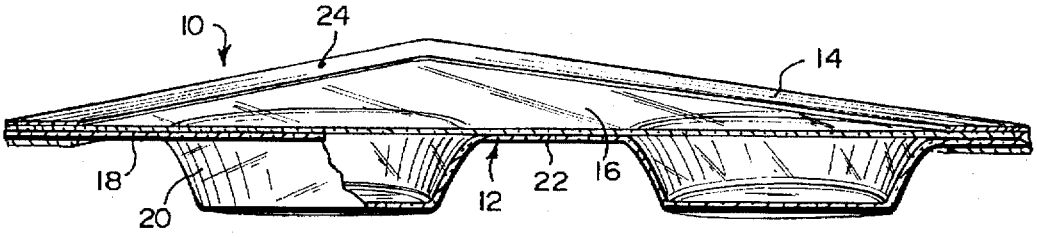
FIG. 6 is an enlarged cross sectional perspective view taken generally along line 6—6 in FIG. 2.

As shown in FIG. 4, a flexible bag 30 can be provided, having an open end 32 and is of a size to store the strip 28 of the frames 14 with the pieces of bubble wrap 12 therein, when the frames 14 are folded up along the perforations 26. A twist tie 34 is to close the open end 32 of the flexible bag 30.

Figure 7:
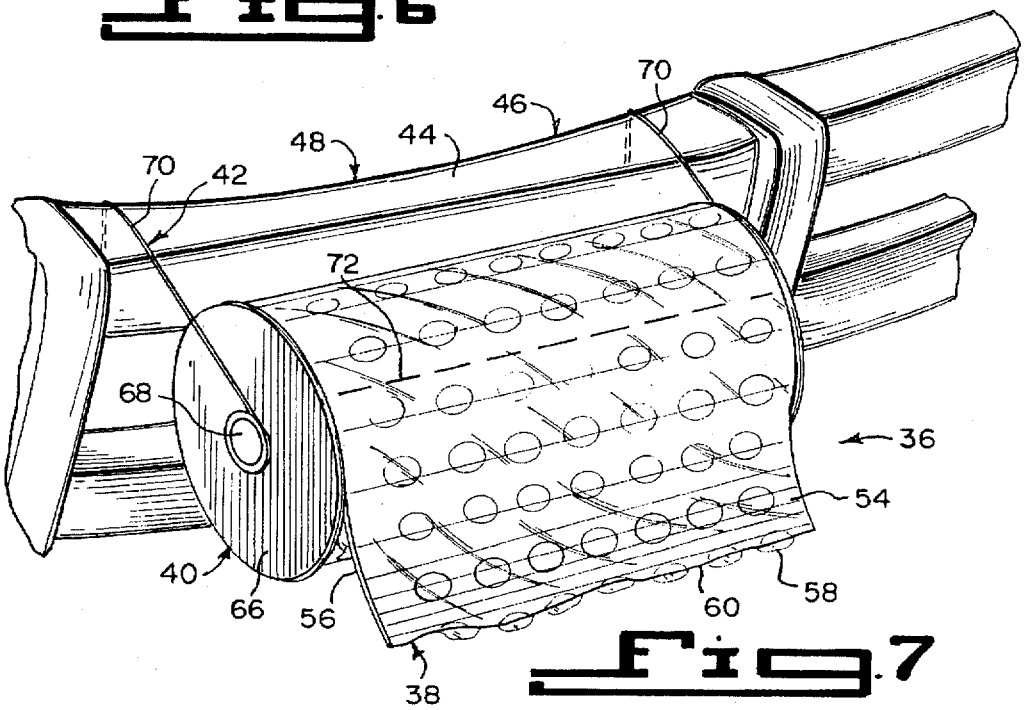
FIG. 7 is a perspective view of a second embodiment of the instant invention, in which a dispenser with a roll of perforated bubble wrap is hung on the back of a stadium seat.
Figure 8:
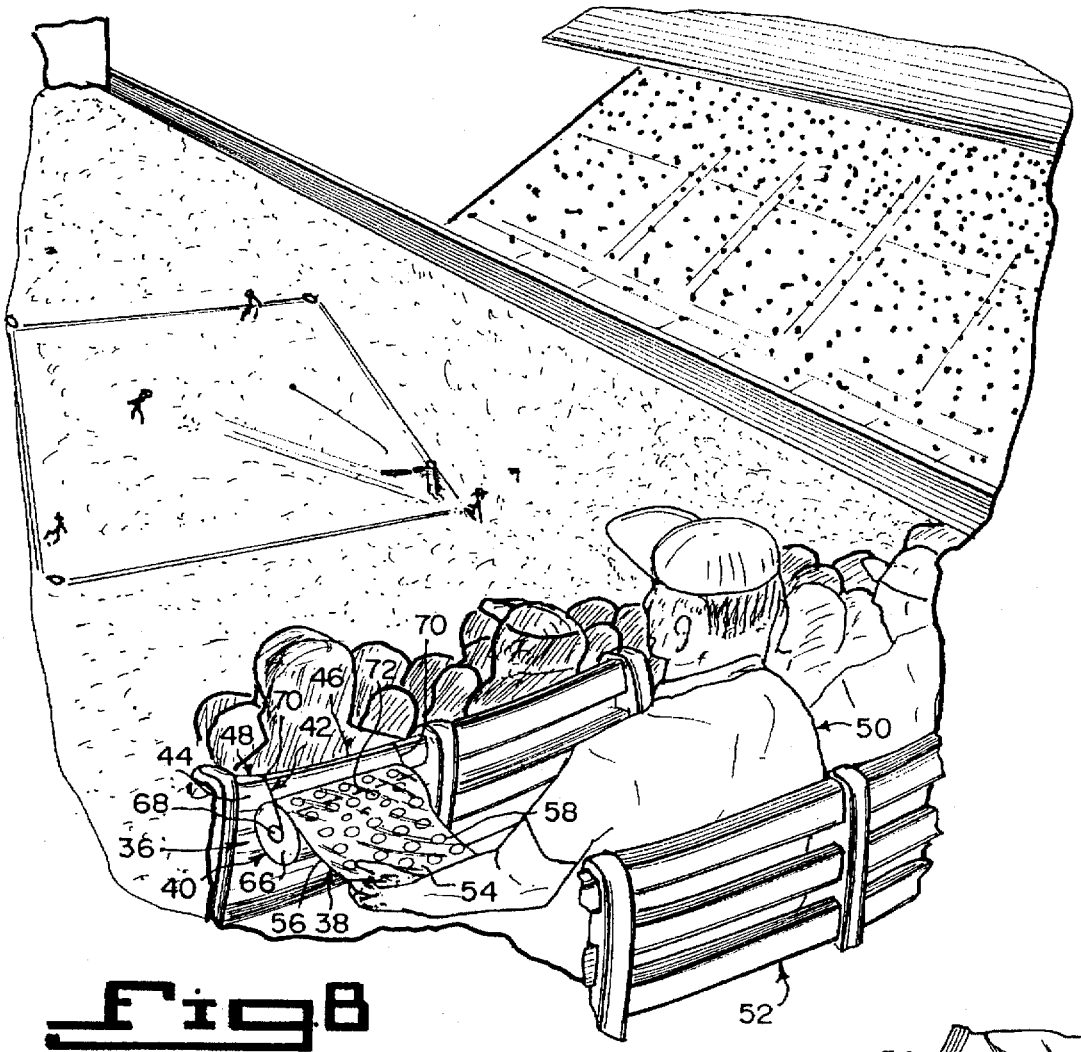
FIG. 8 is a perspective view similar to FIG. 7, but showing a fan utilizing the bubble wrap on the dispenser at a sports arena.
Figure 9:
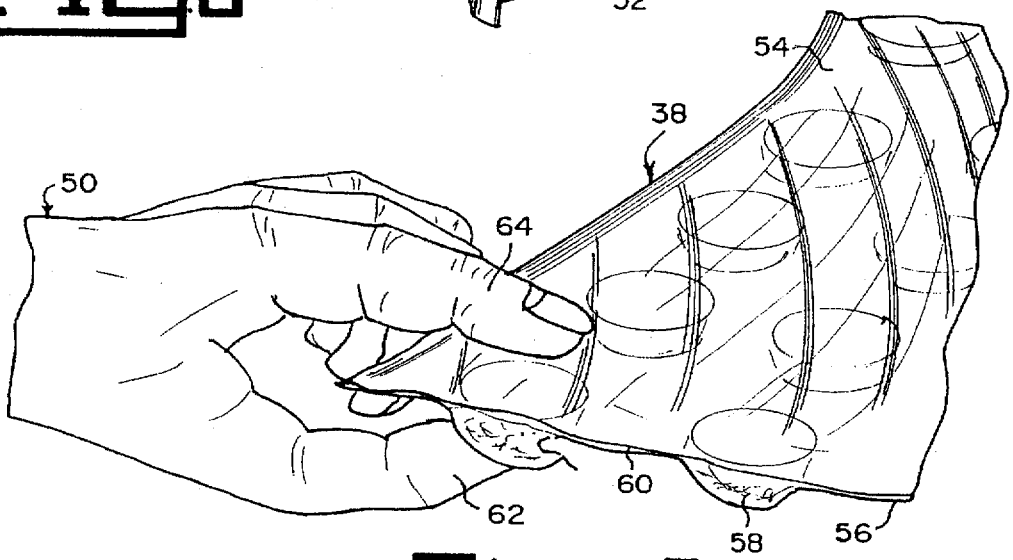
FIG. 9 is an enlarged perspective view of a piece of the bubble wrap showing one of the bubbles being popped by a hand of the fan.

An alternate bubble popping device 36 is shown in FIGS. 7 through 9, and consists of a roll of bubble wrap 38, with a dispenser 40 for holding the roll of bubble wrap 38 thereon. A hanger 42 extends from the dispenser 40 for retaining the dispenser 40 onto a top back portion 44 of a backrest 46 of a first stadium seat 48.

A person 50 sitting on a second stadium seat 52 directly behind the first stadium seat 48 can pull the roll of bubble wrap 38 on the dispenser 40 and squeeze bubble portions of the roll of bubble wrap 38 to make popping noises when the bubble portions break.

The roll of bubble wrap 38 includes a first elongated thin flexible plastic sheet 54 being completely flat. A second elongated thin flexible plastic sheet 56 has a plurality of circular shaped cups 58 formed therealong. A heat seal 60 is for attaching the first elongated thin flexible plastic sheet 54 to the second elongated thin flexible plastic sheet 56, so as to enclose all of the circular shaped cups 58 with a small amount of air to form the bubble portions. The person 50 can squeeze the circular shaped cups 60 between a thumb 62 and finger 64, to break them and make the popping noises, as shown in FIG. 9.

The dispenser 40 is a spool 66 in which the roll of bubble wrap 38 is wound about. The hanger 42 consists of a shaft 68 extending through the center of the spool 66. A pair of hook members 70 extend from opposite ends of the shaft 68 and over the top back portion 44 of the backrest 46 of the first stadium seat 48. The roll of bubble wrap 38 further includes spaced apart transverse perforations 72 thereacross. The person 50 can remove a piece of the bubble wrap 38 by tearing along the perforations 72.

LIST OF REFERENCE NUMBERS

10 bubble popping device
12 piece of bubble wrap of 10
14 frame of 10
16 first thin flexible plastic sheet of 12
18 second thin flexible plastic sheet of 12
20 circular shaped cup in 18
22 heat seal between 18 and 20
23 indicia on 16
24 durable lightweight material of 14
26 perforations between 14
28 elongated strip
30 flexible bag
32 open end of 30
34 twist tie for 32
36 alternate bubble popping device
38 roll of bubble wrap of 36
40 dispenser of 36
42 hanger of 36
44 top back portion of 46
46 backrest of 48
48 first stadium seat
50 person on 52
52 second stadium seat
54 first elongated thin flexible plastic sheet of 38
56 second elongated thin flexible plastic sheet of 38
58 circular shaped cup in 56
60 heat seal between 54 and 56
62 thumb of 50
64 finger of 50
66 spool for 40
68 shaft of 42
70 hook member of 42
72 transverse perforations on 38

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bubble popping device comprising:

a) a plurality of rectangular frames;

b) a length of bubble wrap containing burstable bubbles, said bubble wrap extending through said frames and joining said frames forming a row of frames which are foldable between said frames permitting stacking thereof, all of the bubbles in said bubble wrap being located within said frames, said frames being of stiffer material than said bubble wrap; and c) tear perforations in said bubble wrap between adjacent frames permitting each frame containing bubbles to be conveniently removed for popping of the bubbles within each said frame.

2. The bubble popping device of claim 1 in which said frame material is cardboard.

3. The bubble popping device of claim 1 in which said frame material is plastic.

* * * * *